United States Patent [19]

Kanto et al.

[11] Patent Number: 4,929,592

[45] Date of Patent: May 29, 1990

[54] HEAT TRANSFER SHEET

[75] Inventors: Jumpei Kanto, Komae; Hiroshi Eguchi, Shinjuku, both of Japan

[73] Assignee: Dai Nippon Insatsu Kabushiki Kaisha, Japan

[21] Appl. No.: 284,403

[22] Filed: Dec. 14, 1988

[30] Foreign Application Priority Data

Dec. 17, 1987 [JP] Japan ..... 62-317576

[51] Int. Cl.[5] ..... B41M 5/035; B41M 5/26

[52] U.S. Cl. ..... 503/227; 428/195; 428/411.1; 428/500; 428/515; 428/913; 428/914

[58] Field of Search ..... 8/171; 428/913, 914, 428/195, 411.1, 500, 515; 503/227

[56] References Cited

U.S. PATENT DOCUMENTS 4,253,838 3/1981 Mizuno et al. ..... 428/913
4,737,486 4/1988 Henzel ..... 430/945

FOREIGN PATENT DOCUMENTS 97493 1/1984 European Pat. Off. ..... 428/913

*Primary Examiner*—Pamela R. Schwartz
*Attorney, Agent, or Firm*—Arnold, White & Durkee

[57] ABSTRACT

A heat transfer sheet, comprising a base film and a dye layer formed on the base film, characterized in that an adhesive layer comprising an organic titanate is provided between said base film and said dye layer.

5 Claims, 1 Drawing Sheet

HEAT TRANSFER SHEET

BACKGROUND OF THE INVENTION

This invention relates to a heat transfer sheet, more particularly to a heat transfer sheet which is useful in the heat transfer system by use of a sublimable dye (heat migratable dye), excellent in peel-off prevention, etc. of the dye layer during heat transfer, and can also give excellent image density.

As the method which can give excellent mono-color or full-color (multicolor) image simply and at high speed in place of inking methods or printing methods in general of the prior art, there have been developed the ink jet system or the heat transfer system. Among them, as the method which can give a full-color image comparable with color photography having excellent continuous gradation, the so-called sublimation heat transfer system by use of a sublimatable dye is the most excellent. As the heat transfer sheet to be used in the above sublimation type heat transfer system, there has been generally used one having a dye layer containing a sublimable dye formed on one surface of a base film such as polyester film, and also having on the other hand a heat-resistant layer provided on the other surface of the base film for prevention of sticking of thermal head.

By superposing the dye layer surface of such heat transfer sheet on an image-receiving material having an image-receiving layer comprising a polyester resin, and heating imagewise by a thermal head from the back surface of the heat transfer sheet, the dye in the dye layer is migrated to the image-receiving material to form a desired image.

In the heat transfer system as described above, although there is an excellent advantage that it is possible to obtain the graduation of an image depending on the temperature of the thermal head, if the temperature of the thermal head is elevated in order to make higher the density, there will occur inconvenience that the binder forming the dye layer is softened thereby to be stuck onto the image-receiving material, whereby the heat transfer sheet is adhered to the image-receiving material, and further in an extreme case, there ensues the problem that the dye layer itself will be peeled off during peeling of them and transferred as such onto the image-receiving material surface.

Also, as the method for enhancing image density, there is the method in which the dye concentration in the dye layer is enhanced, but in this case, the binder content in the ratio of the dye and the binder in the dye layer becomes smaller, and as the result there ensues a similar problem as described above.

As the method for solving such problems, there has been proposed a method to provide an adhesive layer comprising a conventional adhesive resin such as polyurethane or polyester between the base film and the dye layer.

However, the method of providing such an adhesive is accompanied with such problems as mentioned below.

(1) Since the dye layer is formed by use of a composition containing a dye and a binder dissolved or dispersed in an organic solvent, the organic solvent in the composition for formation of dye layer dissolves the above adhesive layer formed on the base film during formation of the dye layer, whereby the function of the adhesive layer cannot be sufficiently fulfilled.

(2) If the thickness of the adhesive layer is made larger for solving the above problem (1), heat imparting efficiency from the thermal head to the dye layer will be remarkably lowered.

(3) Also, as the result of thickening of the adhesive layer, the dye in the dye layer will be also heat migrated during recording, with the result that no sufficient image density can be obtained.

SUMMARY OF THE INVENTION

An object of the present invention is to provide a heat transfer sheet which can give high image density without occurrence of peel-off of the dye layer during transfer and yet with good heat efficiency.

The present inventors have studied intensively in order to respond to the demand in the prior art as described above, and consequently found that the problems in the prior art as described above can be solved by forming an adhesive layer comprising a specific material between the base film and the dye layer to accomplish the present invention More specifically, the present invention is a heat transfer sheet comprising a base film and a dye layer, characterized in that an adhesive layer comprising an organic titanate is provided between the base film and the dye layer.

In the heat transfer sheet of the present invention, by providing an adhesive layer comprising an organic titanate between the base film and the dye layer, peel-off of the dye layer during transfer can be prevented, and also the above adhesive layer may be very thin, whereby both heat efficiency of thermal head and printing density will not be lowered.

DETAILED DESCRIPTION OF THE INVENTION

In the following, the present invention is described in more detail by referring to the accompanying drawings which exemplify preferred embodiments of the present invention.

Figure 1:
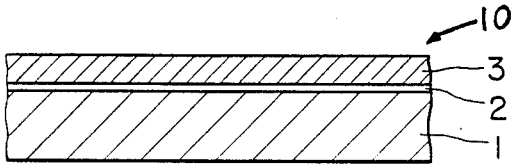
FIG. 1 and FIG. 2 are each schematic sectional views of the heat transfer sheet of the present invention.

FIG. 1 illustrates schematically the basic constitution of the heat transfer sheet 10 of the present invention, and the heat transfer sheet 10 of the present invention comprises a dye layer 3 formed on a base film 1, wherein an adhesive layer 2 comprising an organic titanate is provided between the base film 1 and the dye layer 3 as shown in FIG. 1.

Figure 2:
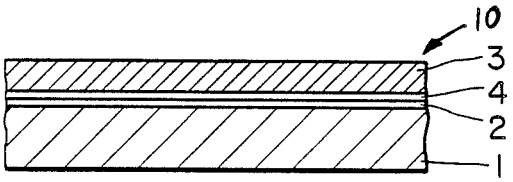

FIG. 2 illustrates another preferred embodiment of the heat transfer sheet 10 of the present invention, wherein an adhesion stabilizing layer 4 is further provided between the adhesive layer 2 and the dye layer 3 in the heat transfer sheet 10 shown in FIG. 1.

As the base film 1 of the heat transfer sheet of the present invention as described above, any material having heat resistance and strength to some extent known in the art may be used. For example, there may be included paper, various converted papers, polyester film, polystyrene film, polypropylene film, polysulfone film, aromatic polyamide, polycarbonate film, polyvinyl alcohol film and cellophane. Particularly, polyester film with a thickness of from 0.5 to 50 μm, more preferably from about 3 to 10 μm.

The adhesive layer 2 formed on the surface of the above base film is formed of an organic titanate. The organic titanate to be used in the present invention is a compound in which 4 (four) bonds on titanium atom are substituted with alkoxy group and/or acylate group, etc., and such organic titanates known in the art are all useful in the present invention. However, according to the detailed study by the present inventors, particularly organic titanates having alkoxy groups or acylate groups thereof with carbon atoms 10 or lower, preferably 5 or lower as shown below were found to be suitable:

Tetra-i-propoxytitanium,
Tetra-n-butoxytitanium,
Di-i-propoxy-bis(acetylacetona)titanium,
Tetrakis(2-ethylhexoxy)titanium,
Poly(tetra-i-propoxy)titanium,
Poly(tetra-n-butoxy)titanium.

The organic titanates as mentioned above are generally liquid or waxy, and it is preferable in the present invention to use these organic titanates as a solution with a concentration of, for example, about 0.1 to 10% by weight dissolved in a solvent which can dissolve these organic titanates, for example, organic solvents such as i-propanol, n-butanol, benzene, toluene, xylene, n-hexane, chloroform, methyl chloroform, carbon tetrachloride. The specific feature of the present invention is that the amount of the above organic titanate coated may be very small, and since good adhesiveness can be exhibited with a small amount of coating, there can be exhibited the characteristic that there is little increase of the thickness of the heat transfer sheet obtained, whereby sensitivity of the heat transfer sheet will not be substantially lowered. A preferable amount of coating may be about 0.01 to 1 $g/m^2$ as the organic titanate component to exhibit sufficient effect. Of course, an amount in excess of the above range involves no particular problem except for economy.

In the present invention, the object of the present invention can be accomplished by forming a dye layer on the surface of the above adhesive layer 2, but an adhesion stabilizing layer 4 can be also formed on the surface of the above adhesive layer.

The adhesion stabilizing layer solves primarily the problems in production process and is also preferable in quality. That is, when the above adhesive layer 2 is formed on the base film 1 and then immediately (namely, without once winding up) the dye layer 3 is formed on its surface, the adhesion stabilizing layer 4 is not required, but when the film 1 is once wound up after formation of the adhesive layer 2, the back surface of the base film 1 contacts the surface of the adhesive layer 2, whereby there occurs the problem that the very thin adhesive layer 2 may be damaged. The adhesion stabilizing layer 4 excludes such problem.

Also, as an another effect, the adhesion stabilizing layer has the effect of preventing migration of the dye in the dye layer 3 formed on the adhesive layer 2 into the base film 1, and it is also preferable in quality in this respect. When the surface of the base film before forming of the adhesive layer and the heat-resistant layer on the back surface of the base film are in contact with each other for a long term, there is the fear that the composition of the heat-resistant layer may be migrated to the surface of the base film before forming of the adhesive layer, thereby to lower the adhesive force between the adhesive layer 2 and the base film 1. In the present invention, for preventing such problem, an adhesion stabilizing layer may be also formed between the base film and the adhesive layer (not shown). In this case, as a preferable resin for the adhesion stabilizing layer, there may be included resins having good adhesive force to the base film, such as polyester type resins or polyurethane type resins.

Also in the present invention, in place of forming the above adhesion stabilizing layer, for the purpose of improving adhesive force between the base film and the adhesive layer, surface treatment such as plasma treatment or corona treatment may be also applied on the base film.

The adhesion stabilizing layer as described above may be formed preferably from a water-soluble or hydrophilic resin which will not be attacked by the organic solvent during formation of the dye layer and has a group reactive with the above organic titanate such as hydroxyl group or carboxyl group.

Specific examples of preferable resins as mentioned above may include, for example, homopolymers comprising unsaturated carboxylic acid such as acrylic acid, methacrylic acid, maleic acid, itaconic acid and the like; copolymers of these unsaturated carboxylic acids with another vinyl monomers, such as styrene-maleic acid copolymer, styrene-(meth)acrylic acid copolymer, (meth)acrylic acid-(meth)acrylic acid ester copolymer, olefin-(meth)acrylic acid copolymer; vinyl alcohol type resins such as polyvinyl alcohol, partially saponified polyvinyl acetate, vinyl alcohol-ethylene-(meth)acrylic acid copolymer, etc.; otherwise polyester resins modified to insoluble or difficulty soluble in the solvent during formation of the dye layer; modified polyamide resins, etc. These resins may be in any form of aqueous solution, organic solvent solution, aqueous dispersion or emulsion in water.

As the method for forming the above adhesion stabilizing layer 4, for example, it can be formed by coating and drying the above aqueous solution, aqueous dispersion, emulsion or organic solvent solution of the resin by conventional coating means such as gravure coater, roll coater or wire bar. The adhesion stabilizing layer 4 may have a thickness of about 0.01 to 1.0 $g/m^2$, preferably about 0.05 to 0.3 $g/m^2$ (solid component), and with a thickness less than this range, no sufficient adhesion stabilizing action can be obtained, while with a thickness exceeding the above range, heat efficiency of thermal head and the color forming density of the transferred image will be excessively lowered undersirably.

The sublimable (heat-migratable) dye layer 3 to be formed on the adhesive layer 2 o the adhesion stabilizing layer 4 as described above is a layer having a dye carried on any desired binder resin.

As the dye to be used, any of the dyes useful in heat transfer sheet known in the art can be effectively used in the present invention, and is not particularly limited. For example, as some preferable dyes, MS Red G, Macrolex Red Violet R, Ceres Red 7B, Samaron Red HBSL, Resolin Red F3BS, etc. may be included as red dyes, Foron Brilliant Yellow 6GL, PTY-52, Macrolex Yellow 6G, etc. as yellow dyes, and Kayaset Blue 714, Waxolin Blue AP-FW, Foron Brilliant Blue S-R, MS Blue 100, etc. as blue dyes.

As the binder resin for carrying heat-migratable dyes as mentioned above, any of those known in the art can be used. Preferable examples may include cellulosic resins such as ethyl cellulose, hydroxyethyl cellulose, ethylhydroxy cellulose, hydroxypropyl cellulose, methyl cellulose, cellulose acetate, or cellulose acetate butyrate; vinyl resins such as polyvinyl alcohol, polyvinyl acetate, polyvinyl butyral, polyvinyl acetoacetal (polyvinyl alcohol acetalated with the use of acetaldehyde), polyvinyl pyrrolidone, or polyacrylamide; polyesters, etc., and among them cellulose type, acetal type, butyral type and polyester type resins in which slight amount of reactive groups such as hydroxyl group remain are preferable with respect to adhesiveness, and also preferable with respect to heat resistance and migratability of dye.

Further, in the present invention, of the above binders as mentioned above, particularly a polyvinyl acetal resin and a polyvinyl butyral resin may be preferably used. That is, these resins are excellent in increasing printing sensitivity (image density) and further improving storability, thus contributing to improvement of the characteristics of the heat transfer sheet synergetically together with the advantage of the adhesive layer of the present invention as described above.

As mentioned above, in the prior art, for increasing the image density, there is the method in which the concentration of the dye contained in the dye layer is enhanced, but increase of the dye concentration means simultaneously making the value of the dye/binder ratio of the dye and the binder constituting the dye layer greater. Accordingly, in the above method, the amount of the binder becomes necessarily smaller, and therefore, there will ensue problems such as peel-off of the dye layer and lowering of storability.

In the present invention, the drawbacks as described above can be cancelled by use of a resin, having affinity for the dye and a relatively higher glass transition temperature, such as polyvinyl acetal resin and polyvinyl butyral resin as described above as the binder. More specifically, by use of these resins as the binder, even when the dye/binder ratio may be made greater, the above problem accompanied therewith will not occur, and therefore the problem of peel-off of the dye layer can be also cancelled together with improvement of image density and storability. From such standpoints, in the present invention, the value of dye/binder ratio of the dye and the binder constituting the dye layer may be desirably 1.0 or higher, preferably 1.4 or higher, more preferably 1.75 or higher for improvement of image density.

The dye layer 3 of the heat transfer sheet of the present invention is formed basically of the above materials, but can also include various additives similarly to those known in the art, if desired.

Such dye layer may be formed preferably by adding the above sublimable dye, binder resin and other optional components in an appropriate solvent to dissolve or disperse the respective components, thereby forming a coating material or ink for formation of dye layer, and then coating and drying this on the above adhesive layer 2 or the adhesion stabilizing layer 4.

The dye layer thus formed has a thickness of 0.2 to 5.0 μm, preferably about 0.4 to 2.0 μm, and the sublimable dye in the dye layer may be suitably present in an amount of 5 to 90% by weight, preferably 10 to 70% by weight based on the weight of the dye layer.

The heat transfer sheet of the present invention as described above can also exhibit sufficient performance as such, but further a tackiness preventive layer, namely a release layer, may be also provided on the surface of the dye layer, and further on the back surface of such sheet for thermal transfer recording of the present invention, a heat-resistant layer may be also provided for preventing deleterious influence from the heat of thermal head.

The image-receiving material to be used for formation of images by use of the heat transfer sheet as described above may be any material, provided that its recording surface has dye receptivity relative to the above dye, and also, when it is paper, metal, glass, synthetic resin, etc. having no dye receptivity, a dye receptive layer may be formed on at least one surface thereof.

As the image-receiving material on which no dye receptive layer may be formed, there may be included, for example, fibers, fabrics, films, sheets and moldings comprising polyolefinic resins such as polypropylene; halogenated polymers such as polyvinyl chloride or polyvinylidene chloride; vinyl polymers such as polyvinyl acetate or polyacrylic ester; polyester resins such as polyethylene terephthalate or polybutylene terephthalate; polystyrene resins; polyamide resins; copolymer resins of olefins such as ethylene or propylene with other vinyl monomers; ionomers; cellulose resins such as cellulose diacetate; polycarbonate, etc. Particularly preferred are sheets or films comprising polyesters or converted papers provided with polyester layer. Also, in the present invention, even a no-dyable image-receiving material such as paper, metal, glass and others can be made an image-receiving material by coating and drying a solution of a dyable resin as described above on its recording surface, or laminating a resin film thereof on the recording surface. Further, even the image-receiving material having dyability as described above may also have a dye-receptive layer formed from a resin with good dyability on its surface similarly as described above in the case of paper.

The dye receptive layer thus formed may be formed from either a single material or a plurality of materials, and further various additives may be included within the range which does not interfere with the object of the present invention as the matter of course.

Such dye receptive layer may have any desired thickness, but generally a thickness of 5 to 50 μm. Also, such dye receptive layer may be preferably a continuous coating, but also it may be formed as an uncontinuous coating by use of a resin emulsion or resin dispersion.

As the heat energy imparting means to be used in performing heat transfer by use of the above heat transfer sheet and an image-receiving material as described above, any of imparting means known in the art is available. For example, by means of a recording device such as thermal printer (e.g. video printer VY-100, produced by Hitachi K.K., Japan), etc., by controlling the recording time to impart heat energy of about 5 to 100 $mJ/mm^2$, a desired image can be formed.

According to the present invention as described above, by provision of an adhesive layer comprising an organic titanate between the base film and the dye layer, the following advantages can be achieved.

(1) Since peel-off of the dye layer can be well prevented, and also said adhesive layer will not be dissolved or denatured, or very difficultly, if any, with the organic solvent for formation of the dye layer, it is not required to be formed so thick as in the prior art, but may be an extremely thinner layer than the adhesive layer of the prior art, whereby lowering in efficiency of heat utilization from the thermal head is little to accomplish recording with excellent image density.

(2) Also, by forming an adhesion stabilizing layer on the adhesive layer, problems in steps can be also cancelled, and also an advantage in quality can be obtained.

The present invention is described below in more detail by referring to Examples. In the sentences, parts or % are based on weight unless otherwise noted.

EXAMPLE 1

On the surface of a polyethylene terephthalate film with a thickness of 6 μm applied with heat-resistant treatment at the back surface on which a dye layer is to be formed as the base film, a composition for formation of an adhesive layer shown below was coated and dried at a proportion to give a thickness on drying of 0.1 g/m$^2$, and subsequently without once winding up, a composition for formation of a dye layer shown below was coated and dried to a thickness on drying of 1.0 g/m$^2$ to prepare a heat transfer sheet of the present invention.

| | |
|---|---|
| Composition for formation of adhesive layer | |
| Tetra-i-propoxytitanium | 0.5 part |
| 2-Propanol | 50.5 parts |
| Toluene | 49.5 parts |
| Composition for formation of dye layer | |
| Solvent Blue 36 | 7.0 parts |
| Polyvinyl butyral (produced by Sekisui Chemical Co. Ltd., Japan, "BX-1") | 3.5 parts |
| Methyl ethyl ketone | 45.0 parts |
| Toluene | 44.5 parts |
| Dye/binder ratio = 2.0 | |

EXAMPLES 2 to 5

Heat transfer sheets of the present invention were obtained in the same manner as in Example 1 except for using the materials shown below in place of the organic titanate and the composition for formation of dye layer in Example 1 (in the brackets are shown amounts of coating on drying).

EXAMPLE 2

| | |
|---|---|
| Organic titanate: Tetra-n-butoxytitanium | 0.03 g/m$^2$ |
| Composition for formation of dye layer | |
| Solvent Blue 63 | 5.0 parts |
| Vinyl chloride-vinyl acetate copolyer (produced by Denki Chemical Industries, Ltd., Japan, "#1000D") | 3.5 parts |
| Methyl ethyl ketone | 41.0 parts |
| Toluene | 45.5 parts |
| Dye/binder ratio = 1.43 | |

EXAMPLE 3

| | |
|---|---|
| Organictitanate: Di-i-propoxy bis(acetylacena) titanium | (0.01 g/m$^2$) |
| Composition for formation of dye layer | |
| Disperse Yellow 141 | 6.0 parts |
| Cellulose acetate (produced by Daicel Kagaku Kogyo, K.K., Japan, "L-70") | 3.5 parts |
| Methyl ethyl ketone | 45.5 parts |
| Toluene | 45.0 parts |
| Dye/binder ratio = 1.71 | |

EXAMPLE 4

| | |
|---|---|
| Organic titanate: Poly(tetra-i-propoxy)titanium | (0.2 g/m$^2$) |
| Composition for formation of dye layer | |
| Solvent Red 19 | 5.0 parts |
| Polyester (produced by Nippon Gosei Synthetic Chemical Industry Co. Ltd., Japan, "Polyester L-1136") | 3.5 parts |
| Methyl ethyl ketone | 46.0 parts |
| Toluene | 45.5 parts |
| Dye/binder ratio = 1.43 | |

EXAMPLE 5

| | |
|---|---|
| Organic titanate: Poly(tetra-i-butoxy)titanium | (0.05 g/m$^2$) |
| Composition for formation of dye layer | |
| Solvent Blue 63 | 3.0 parts |
| Solvent Blue 36 | 6.0 parts |
| Polyvinyl acetal (produced by Sekisui Chemical Co. Ltd., Japan, "BV-5") | 3.5 parts |
| Methyl ethyl ketone | 44.0 parts |
| Toluene | 43.5 parts |
| Dye/binder ratio = 2.57 | |

EXAMPLES 6 to 10

In Examples 1 to 5, after formation of adhesive layer, further a composition for formation of a protective layer shown below was coated and dried on its surface at a proportion to give a coated amount on drying of 0.1 g/m$^2$, and after once wound up, a dye layer was formed in the same manner as in Example 1 to give heat transfer sheets of the present invention.

Composition for formation of adhesion stabilizing layer

| | |
|---|---|
| Styrene-maleic acid copolymer (produced by Seiko Kagaku Kogyo, K.K., Japan, "Aqueous varnish B") | 1.0 part |

EXAMPLES 11 to 15

Heat transfer sheets of the present invention were obtained in the same matter as in Example 6 except for using water-soluble resin shown below in place of water-soluble resin and composition for formation of dye layer in Example 6 (in the brankets are shown amount of coating on drying).

EXAMPLE 11

Polyvinylalchol (produced by Nippon Synthetic Chemical Industry Co. Ltd., Japan, "Gosefimer L5407") (0.1 g/m$^2$).

EXAMPLE 12

Water-soluble polyvinylacetal (produced by Sekisui Chemical Co. Ltd., Japan, "Eslec W102") (0.3 g/m$^2$).

EXAMPLE 13

| | |
|---|---|
| Acrylic resin (produced by Johnson, "Johncryl 62") | (0.2 gm$^2$) |

EXAMPLE 14

| | |
|---|---|
| Stylene-maleic acid copolymer (produced by Seiko Kagaku Kogyo, K.K., Japan, "E-1714LP") | (0.05 g/m$^2$) |

EXAMPLE 15

| | |
|---|---|
| Stylene-maleic acid copolymer (produced by Seiko Kagaku Kogyo, K.K., Japan, "E-1714LP") | (0.1 g/m$^2$) |

EXAMPLE 16

In Examples 1 to 5, before formation of the adhesive layer, a composition for formation of adhesion stabilizing layer was coated and dried at a proportion to give a coated amount on drying of 0.1 g/m$^2$, followed by formation of the adhesive layer and the dye layer in the same manner as in Example 1 to give heat transfer sheets of the present invention.

Composition for formation of adhesion stabilizing layer

| | |
|---|---|
| Polyester (produced by Toyo Morton, K.K., Japan, "Adcoat 335A") | 4.0 parts |
| Dioxane | 66.0 parts |
| Methyl ethyl ketone | 30.0 parts |

COMPARATIVE EXAMPLE 1

Example 1 was repeated except for forming no adhesive layer to obtain a heat transfer sheet of Comparative Example.

COMPARATIVE EXAMPLE 2

Example 6 was repeated except for forming no adhesive layer to obtain a heat transfer sheet of Comparative Example.

Adhesion strength test

On the dye layer surface of the heat transfer sheets of the above Examples and Comparative Examples, a adhesive tape ("Mending tape 810", produced by Sumitomo 3M, Japan) was adhered under a pressure of 1 kg/m$^2$, and under the state where the heat transfer sheet was fixed, the tape was peeled off in the direction of 180°, and the adhesion strength was evaluated from the area of the dye layer peeled off. As the result, in the case of the heat transfer sheets of Examples 1 to 11, the peeling ratio was 0%, while in the case of Comparative Example 1, it was 100%, and, in the case of Comparative Example 2.93%.

Transfer recording test

With the heat transfer sheets of the above Examples and Comparative Examples and an image-receiving sheet having an image-receiving layer prepared by the following method and the image-receiving layer being opposed to each other, thermal head recording was performed from the back surface of the heat transfer sheet under the conditions of a head application voltage of 12.0 V, a printing time of 16.0 msec/line and running speed of 33.3 msec/line.

Preparation of image-receiving sheet

By use of a synthetic paper with a thickness of 150 μm (produced by Oji Yuka, Japan: YUPO-FPG-150) as the substrate sheet, a coating composition for receiving layer having a composition shown below was applied on the surface by wire bar coating to form an image-receiving sheet with a thickness of 10 μm on drying. Drying was performed after tentative drying by a dryer in an oven of a temperature of 100° C. for 30 minutes.

Coating composition for receiving layer

| | |
|---|---|
| Polyester resin (produced by Toyobo, Japan: Vylon 600) | 5.4 parts by wt. |
| Polyvinyl chloride-vinyl acetate resin (produced by Denki Kagaku Kogyo, K.K, Japan: Denkavinyl #1000A) | 8.0 parts by wt. |
| Amino-modified silicone oil (produced by Shinetsu Kagaku, Japan: KF-393) | 0.25 part by wt. |
| Epoxy-modified silicone oil (produced by Shinetsu Kagaku, Japan: X-22-343) | 0.25 part by wt. |
| Antioxidant (produced by Cib-Geigy: IRGANOX-245) | 1.3 parts by wt. |
| Toluene | 42.4 parts by wt. |
| Methyl ethyl ketone | 42.4 parts by wt. |

As a result, in any of the cases of the heat transfer sheets of Examples, the dye layer will not be migrated as such to the image-receiving layer surface during recording, and peeling characteristic between the transfer sheet and the image-receiving material after recording was also good. The recorded image obtained exhibited sharp color formation, substantially without lowering in color density by provision of an adhesive layer.

In contrast, in the case of Comparative Examples, the dye layer was peeled off at considerable ratio to be migrated to the image-receiving material, thereby giving partially indistinct images.

What is claimed is:

1. A heat transfer sheet comprising a base film and a sublimable dye layer containing a binder formed on the base film, characterized in that an adhesive layer comprising an organic titanate is provided between said base film and said dye layer and wherein the weight ratio of the dye to the binder (dye/binder ratio) both constituting said dye layer is 1.4 or more.

2. A heat transfer sheet according to claim 1, wherein an adhesion stabilizing layer is further formed on at least one surface of said adhesive layer.

3. A heat transfer sheet according to claim 2, wherein an organic solvent is employed during formation of the dye layer, and wherein said adhesion stabilizing layer comprises a resin with low solubility in said solvent.

4. A heat transfer sheet according to claim 1, wherein the binder contained in said dye layer comprises a polyvinyl acetoacetal resin or a polyvinyl butyral resin.

5. A heat transfer sheet according to claim 4, wherein the weight ratio of the dye to the binder (dye/binder ratio) both constituting said dye layer is 1.75 or more.

* * * * *